US005212530A

United States Patent [19]

Harada et al.

[11] Patent Number: 5,212,530

[45] Date of Patent: May 18, 1993

[54] CLEANING UNIT FOR A XEROGRAPHIC PRINTING MACHINE

[75] Inventors: Toshimitsu Harada, Ibaraki; Sadaki Maeda, Osaka; Shinichi Nishino; Toshitaka Ogawa, both of Ibaraki, all of Japan

[73] Assignee: Hitachi Koki Co., Ltd., Tokyo, Japan

[21] Appl. No.: 800,088

[22] Filed: Nov. 29, 1991

[30] Foreign Application Priority Data

Nov. 30, 1990 [JP] Japan ..... 2-337683

[51] Int. Cl.[5] ..... G03G 21/00

[52] U.S. Cl. ..... 355/301; 355/297; 355/302; 118/652

[58] Field of Search ..... 355/296–299, 355/301–303; 118/652

[56] References Cited

U.S. PATENT DOCUMENTS 4,440,488 4/1984 Maekawa et al. ..... 355/299
4,469,434 9/1984 Yamazaki et al. ..... 355/299
4,755,853 7/1988 Shimizu et al. ..... 118/652 X
4,786,943 11/1988 Fukae et al. ..... 118/652 X
4,870,466 9/1989 Iida ..... 355/297
4,967,231 10/1990 Hosoya et al. ..... 355/296 X
4,970,560 11/1990 Lindblad et al. ..... 355/299

*Primary Examiner*—A. T. Grimley
*Assistant Examiner*—Matthew S. Smith
*Attorney, Agent, or Firm*—Sughrue, Mion, Zinn, Macpeak & Seas

[57] ABSTRACT

A cleaning unit for a xerographic printing machine, or the like. A system for mechanically or electrostatically removing objects, such a toner or paper particles in a printing machine from a photoreceptor or other member to be cleaned, includes a cleaning brush rotating in contact with the member to be cleaned, a cleaning roll brought into contact with the cleaning brush to electrostatically or magnetically remove toner from the cleaning brush, and a cleaning blade supported at the base by a blade holder. The cleaning blade is pressed against the cleaning roll, to remove toner deposited on the surface of the cleaning roll. The cleaning blade is a resilient, thin metal plate.

10 Claims, 2 Drawing Sheets

CLEANING UNIT FOR A XEROGRAPHIC PRINTING MACHINE

BACKGROUND OF THE INVENTION

1. Field of the Invention

The present invention relates to a cleaning unit for a photoreceptor in a xerographic printing machine, or the like.

2. Description of the Related Art

FIGS. 5 and 6 are sectional views showing a conventional cleaning unit for a xerographic printing machine. Toner 2, left on photoreceptor 1 after it is turned through a sequence of process steps consisting of charging, exposure, development, and fuzing, is electrostatically removed by conductive cleaning brush 3, which is electrically biased by biasing voltage supply 8. Toner 2 is then electrostatically transferred to cleaning roll 4 which is also electrically biased by another biasing voltage supply 9 of which the bias voltage is higher than that of biasing voltage 8. Subsequently, toner 2 is transferred to rubber blade 11, which is fixedly held by blade holder 5. Toner 2 is scraped off cleaning roll 4 by rubber blade 11 and discharged outside the printing machine by toner collecting screw 7.

Of course, when the top or cutting edge of rubber blade 11 is worn or cracked, it does not properly scrape toner 2 off of cleaning roll 4. In such a case, toner will stick to conductive cleaning brush 3 and penetrate into the bristles thereof so as to fill conductive cleaning brush 3 with toner 2. Conductive cleaning brush 3, when filled with toner 2, may fail to remove toner 2 from photoreceptor 1, and consequently, the printer fails to print properly.

In the conventional cleaning unit, rubber blade 11 is made of urethane rubber, for example, and cleaning roll 4 is made of metal, such as aluminum or stainless steel. To remove toner 2 from the surface of cleaning roll 4, rubber blade 11 is resiliently pressed against cleaning roll 4. Such a cleaning unit, however, has the following defects:

1) The lifetime of the blade top is short, since it is easily worn. Thus, the blade must be frequently replaced.

2) The blade top is readily damaged by hard foreign materials, such as carriers and paper dust.

3) Frictional resistance F between the blade and the cleaning roll is large. Therefore, the blade tends to roll up at the cutting edge.

4) Because of factors (1) and (3) above, the pressure N of the blade against the cleaning roll is limited. Because the blade is resilient, the foreign materials are readily introduced between the blade and the cleaning roll. This results in white lines on the reproduction.

5) The toner is prone to stick to the surface of the cleaning roll.

SUMMARY OF THE INVENTION

The present invention has been made in view of the above circumstances and has an object to provide a cleaning unit for cleaning a photoreceptor in a xerographic printing machine, which is relatively maintenance free, and has a long lifetime and low running cost per page.

To achieve the above object, the invention is a cleaning unit for a xerographic printing machine having a system for mechanically or electrostatically removing objects to be removed for cleaning, such as toner or paper particles in a printing machine based on a xerographic process. The cleaning unit includes a cleaning brush rotating in contact with the member to be cleaned, a cleaning roll brought into contact with the cleaning brush so as to electrostatically, or magnetically, remove toner from the cleaning brush, and a cleaning blade supported at its base by a blade holder. The cleaning blade is pressed against the cleaning roll, so as to remove toner deposited on the surface of the cleaning roll. The cleaning blade is a resilient, thin metal leaf.

In this case, the metal leaf may be made of any of phosphorus bronze, stainless steel, or carbon steel, or the like. The cleaning roll may also be made of various metals.

In the cleaning unit of the invention, the cleaning blade is made of a metal having a different hardness than that of the cleaning roll. With this unique construction, the lifetime of the blade is extended, and the toner and foreign materials are effectively removed. Accordingly, the lifetime of the cleaning unit is elongated, the running cost per page is reduced, and low maintenance operation of the cleaning unit is realized. The cleaning blade may be made of phosphorus bronze, for example, and the cleaning roll may be made of stainless steel, for example. Also, the cleaning roll and the cleaning blade may be made of the same kind of metal, and either the cleaning blade and the cleaning roll can be subjected to heat treatment or surface treatment so as to change the hardness thereof. The cleaning unit is most operable when the plane roughness accuracy of the top of the cleaning blade is 10 μm or less, the average surface roughness accuracy of the cleaning roll is 10 μm or less, and the tool angle of the cleaning blade with respect to the cleaning roll is 90° or less.

In the cleaning unit for a xerographic printing machine, according to the invention, the metal blade is bonded to the bonding surface of an extended part of the blade holder in a state that the blade forwardly extends a distance from the holder, and is slightly bent toward the front side of the cleaning roll. The extended part of the blade holder bearing the metal blade thereon is inclined with relation to the cleaning roll so as to satisfy the following relations:

$$\theta 1 < 90^\circ,\ \theta 1 < \theta 2 <,\ \theta 2 < \theta 3, \text{ and } 90^\circ < \theta 3 < 180^\circ,$$

where, when a line Z—Z is normal to a line P-P tangent to a top surface of the metal blade at a contact portion between the top surface of the metal blade and the cleaning roll, $\theta 1$ is an angle between the line Z—Z and a line Y—Y tangentially extending from the bonding surface of the blade holder;

$\theta 2$ is an angle between line Z—Z and the line P—P; and $\theta 3$ is an angle between the line Z—Z and a line X—X tangent to a surface of the cleaning roll at the contact portion between the metal blade and the cleaning roll.

Also in the cleaning unit, pressure N of the blade against the roll satisfies the relation $1\ g/cm \leqq N \leqq 20\ g/cm$.

Other objects, features, and advantages of the invention will be apparent when carefully reading the following detailed description in connection with the accompanying drawings.

DETAILED DESCRIPTION OF THE PREFERRED EMBODIMENTS

The preferred embodiment of the present invention will now be described with reference to FIGS. 1 through 4.

Figure 1:
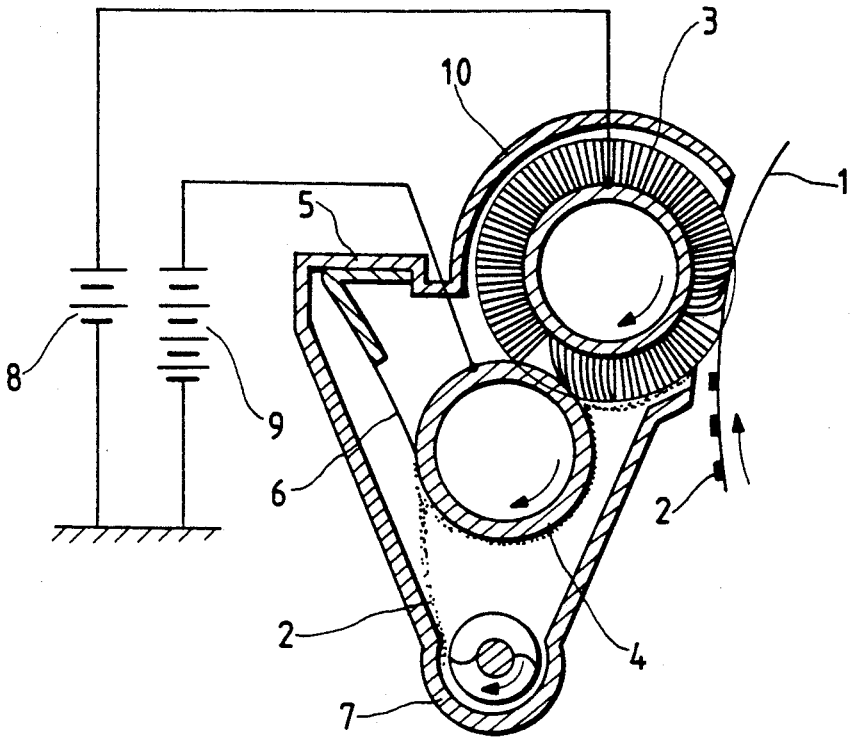
FIG. 1 is a vertical sectional view showing a cleaning unit for a photoreceptor in a xerographic printing machine, which is an embodiment of the present invention.

FIG. 1 is a vertical sectional view showing a cleaning unit and its related construction in a xerographic printing machine, for example. Toner 2 left on photoreceptor 1 is electrostatically removed by conductive cleaning brush 3 which is electrically biased by biasing voltage supply 8. Toner 2 is then electrostatically attracted to cleaning roll 4 which is also electrically biased by another biasing voltage supply 9 which has a bias voltage that is higher than that of biasing voltage supply 8. Toner 2 is subsequently scraped off of cleaning roll 4 by metal blade 6, which is supported by blade holder 5, and forcibly discharged outside the printing machine by toner collecting screw 7.

Figure 2:
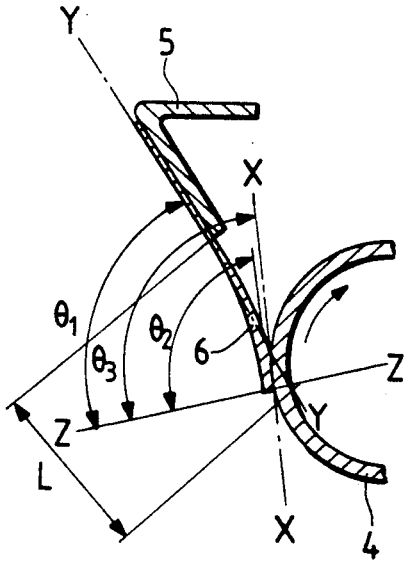
FIG. 2 is an enlarged sectional view showing the structure including a metal blade and a cleaning roll in the cleaning unit of FIG. 1.

FIG. 2 is a vertical sectional view of the preferred embodiment including metal blade 6 and cleaning roll 4. As shown, metal blade 6 is bonded to a bonding surface of an extended part of blade holder 5 so that metal blade 6 extends a distance L from the end of blade holder 5, and is slightly bent toward the front side of cleaning roll 4. The extended part of blade holder 5, bearing metal blade 6 thereon, is inclined with relation to cleaning roll 4 so as to satisfy the following relations $\theta 1<90°$, $\theta 1<\theta 2$, $\theta 2<\theta 3$, and $90°<\theta 3<180°$, where $\theta 1$ is an angle which lies, on the front side of cleaning roll 4, between the line Y—Y extending from the bonding surface of blade holder 5 and a line Z—Z normal to the line P—P. $\theta 2$ is an angle between the line Z—Z and the line P—P. The surface of metal blade 6 at a contact portion of $\theta 3$ is an angle between the normal line Z—Z and a tangent X—X to the curve of cleaning roll 4 at a contact portion between the metal blade 6 and cleaning roll 4.

Figure 3:
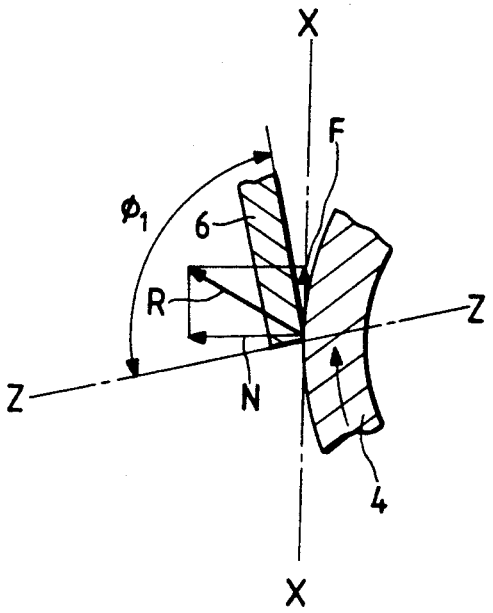
FIG. 3 is an enlarged sectional view of a part of the structure of FIG. 2 where the metal blade contacts the cleaning roll.

FIG. 3 is an enlarged sectional view of a portion of the structure where metal blade 6 contacts cleaning roll 4. In the preferred embodiment, the angle $\phi 1$, of metal blade 6 is set at 90°. Metal blade 6 is brought into resilient contact with cleaning roll 4 at a pressure N. The frictional resistance between blade 6 and cleaning roll 4 is F. Because F is small, most of the resultant force R is used to remove toner and foreign materials from the surface of cleaning roll 4.

In the embodiment, metal blade 6 is a metal leaf of 0.1 mm thickness, which is made of a phosphorus bronze consisting of copper, tin, and phosphorus. Cleaning roll 4 is a stainless steel pipe. Thus, hardness of metal blade 6 is lower than that of cleaning roll 4. The surface roughness accuracy of the top of metal blade 6 is 2 μm, or less. The surface roughness accuracy of cleaning roll 4 is 3 μm, or less. The cleaning unit of the above specifications will successfully remove toner having an average particle diameter of 10 μm and a minimum particle diameter of 6 μm.

Length L, the distance metal blade 6 extends from blade holder 5, is between 10 and 20 mm inclusive. Pressure N of blade 6 against cleaning roll 4 is between 5 g/cm and 15 g/cm, inclusive. Under this condition, the lifetime of metal blade 6 was approximately 1,000,000 pages, while that of the conventional blade was only 100,000 pages.

Figure 4:
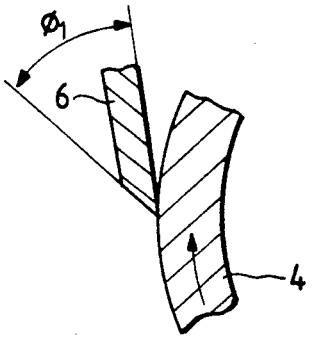
FIG. 4 is an enlarged sectional view showing the shape of the cutting edge of the metal blade which is another embodiment of the invention.
Figure 5:
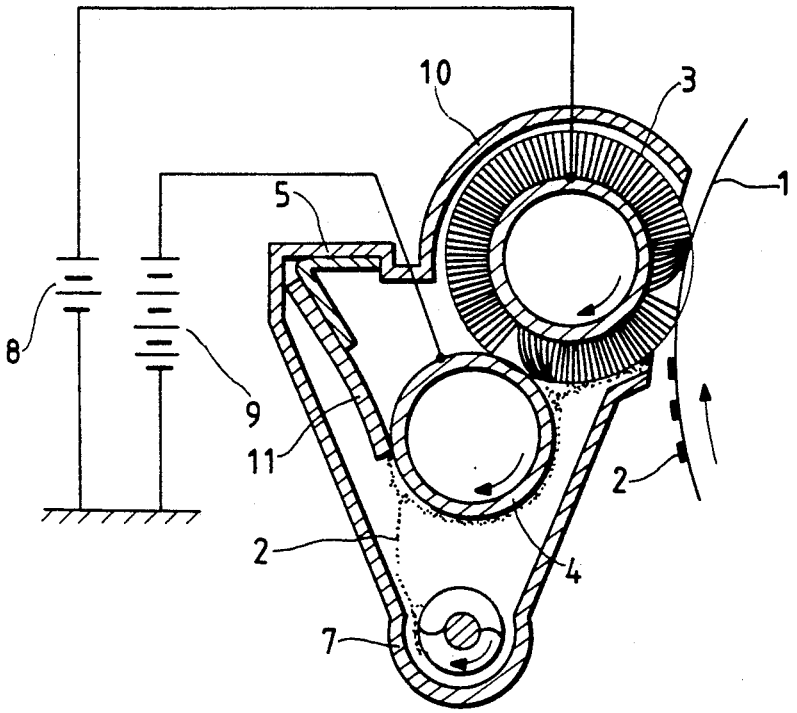
FIG.5 PRIOR ART
FIG. 5 is a sectional view showing a conventional cleaning unit for a xerographic printing machine.
Figure 6:
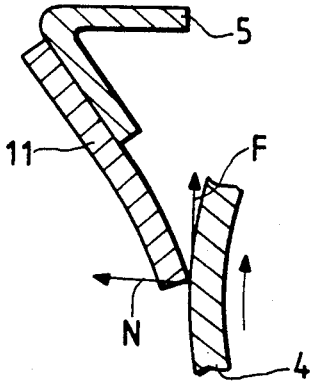
FIG. 6 PRIOR ART
FIG. 6 is an enlarged sectional view showing the structure, including a rubber blade and a cleaning roll, of the cleaning unit of FIG. 5.

FIG. 4 is an enlarged sectional view showing the shape of the cutting edge of the metal blade according to a second embodiment of the invention. In the second embodiment, a tangent to a distal end of the metal blade 6 maintains an angle of 90° or less with respect to the line P—P. If this angle is selected within the range, the entering of toner and foreign materials between metal blade 6 and cleaning roll 4, is further impeded.

In the second embodiment as stated above, phosphorus bronze is used to construct metal blade 6 and stainless steel is used to construct cleaning roll 4. With the combination of the different materials, the hardness of metal blade 6 is lower than that of cleaning roll 4. If required, the same kind of material, such as stainless or carbon steel, may be used for both metal blade 6 and cleaning roll 4. In this case, like the first embodiment, either metal blade 6 or cleaning roll 4 should be subjected to heat treatment or surface treatment. Additionally, for example, metal blade 6 could be made of carbon steel after it is subjected to heat treatment, while cleaning roll 4 may be made of copper.

In cases where the particle diameter of the toner is smaller than that of the toner as referred to in the above embodiments, the roughness accuracy of metal blade 6 and the surface of cleaning roll 4 must be increased correspondingly.

The pressure N may be decreased to be lesser than that in the embodiment by increasing the length L and making metal blade 6 thicker. Conversely, it may be increased by decreasing the length L and making metal blade 6 thinner.

As seen from the foregoing description, in the cleaning unit of the invention, the cleaning blade is made of metal and a difference of hardness between the blade and the cleaning roll is created. With this unique construction, the lifetime of the blade is elongated, and the toner and foreign materials are effectively removed. Accordingly, the lifetime of the cleaning unit per se is elongated, the running cost per page is reduced, and low maintenance operation of the cleaning unit is realized. Of course, the present invention is not limited to use in xerographic printers. On the contrary, the present invention can be applied in any device where small particles must be removed from a surface.

While there has been described what is at the present considered to be the preferred embodiments of the invention, it will be understood by those skilled in the art that the foregoing and other changes in form and detail can be made therein without departing from the spirit and scope of the invention.

What is claimed is:

1. A cleaning unit for mechanically or electrostatically removing particles from a member to be cleaned, comprising:

a cleaning brush in rotating contact with a member to be cleaned;

a cleaning roll, in contact with said cleaning brush so as to electrostatically and magnetically remove particles from said cleaning brush; and a cleaning blade supported in cantilever fashion at a base thereof by a blade holder, said cleaning blade being positioned such that a top surface of said cleaning blade presses against said cleaning roll at a free end of said blade so as to remove said toner deposited on a surface of said cleaning roll, said cleaning blade being a resilient, thin metal plate;

wherein said cleaning blade is bonded to a bonding surface of said blade holder so that said cleaning blade extends from an end of said blade holder, said cleaning blade is bent in a concave manner on a bottom surface thereof opposite of said cleaning roll, and said bonding surface is inclined with relation to said cleaning roll so as to satisfy the angular relationships $\theta 1 < 90°$, $\theta 1 < \theta 2$, $\theta 2 < \theta 3$, and $90° < \theta 3 < 180\infty$, where, when a line Z—Z is normal to a line P—P tangent to said top surface of said cleaning blade at a contact portion between said top surface of said cleaning blade and said cleaning roll:

$\theta 1$ is an angle between the line Z—Z and a line Y—Y tangentially extending from said bonding surface of said blade holder;

$\theta 2$ is an angle between the line Z—Z and the line P—P; and $\theta 3$ is an angle between the line Z—Z and a line X—X tangent to a surface of said cleaning roll at said contact portion between said cleaning blade and said cleaning roll.

2. The cleaning unit as claimed in claim 1, wherein said metal plate is constructed of any one of phosphorus bronze, stainless steel, and carbon steel.

3. The cleaning unit as claimed in claim 1, wherein said cleaning roll and said cleaning blade are constructed of different kinds of metals from each other.

4. The cleaning unit as claimed in claim 3, wherein said cleaning blade is constructed of phosphorus bronze, and said cleaning roll is constructed of stainless steel.

5. The cleaning unit as claimed in claim 1, wherein said cleaning roll and said cleaning blade are constructed of the same kind of metal, and one of said cleaning blade and said cleaning roll is subjected to one of a heat treatment and surface treatment so as to change a surface hardness thereof.

6. The cleaning unit as claimed in claim 1, wherein said cleaning blade is made of heat-treatment applied carbon steel, and said cleaning roll is made of copper.

7. The cleaning unit as claimed in claim 1, wherein a plane roughness accuracy of a surface of said cleaning blade is 10 μm or less.

8. The cleaning unit as claimed in claim 1, wherein an average surface roughness accuracy of said cleaning roll is 10 μm or less.

9. The cleaning unit as claimed in claim 1, in which a tangent to a surface of a distal end of said cleaning blade maintains an angle of 90° or less with respect to the line P—P.

10. The cleaning unit as claimed in claim 1, in which pressure N of said metal blade against said cleaning roll satisfies the relation $1\ g/cm \leqq N \leqq 20\ g/cm$.

* * * * *